United States Patent [19]

Hemming

[11] 4,007,308

[45] Feb. 8, 1977

[54] PROCESS FOR THE PRODUCTION OF PILE SURFACED ARTICLES FROM POLYESTERS

[75] Inventor: Malcolm Hemming, Delamere, England

[73] Assignee: Imperial Chemical Industries Limited, London, England

[22] Filed: Mar. 13, 1975

[21] Appl. No.: 557,903

[30] Foreign Application Priority Data

Mar. 19, 1974 United Kingdom ..... 12077/74

[52] U.S. Cl. ..... 428/92; 264/164; 264/280; 264/284; 428/85; 428/97

[51] Int. Cl.[2] ..... B29C 17/02

[58] Field of Search ..... 428/92, 85, 91, 97; 264/47, 88, 164, 167, 171, 175, 280, 284, 293, 335

[56] References Cited

UNITED STATES PATENTS

| | | | |
|---|---|---|---|
| 3,696,183 | 10/1972 | Steel | 264/164 |
| 3,708,565 | 1/1973 | Seiffert | 264/88 |

*Primary Examiner*—Marion E. McCamish
*Attorney, Agent, or Firm*—Cushman, Darby & Cushman

[57] ABSTRACT

A process for producing pile-surfaced articles from crystal forming polymers with glass/rubber transition temperatures above ambient temperatures comprising drawing fibres from a sheet of amorphous polymer with a heated surface and crystallizing the polymer.

15 Claims, No Drawings

PROCESS FOR THE PRODUCTION OF PILE SURFACED ARTICLES FROM POLYESTERS

The present invention relates to the production of pile surfaced articles from polyesters.

It has already been proposed to produce a pile on the surface of a synthetic polymeric material by pressing the material against a surface, preferably a roll which is heated to the softening temperature of the polymer and separating the material from the surface while cooling the material to below its softening point. In this way the synthetic polymeric material adheres to the heated surface and as it is separated therefrom fibrils of the material are drawn out and the cooling action ensures that the major part of each fibril remains integral with the polymeric material to produce a pile surfaced sheet. In the preferred mode of operation of this technique the polymeric material is a thermoplastic and cold air or another cooling medium is blown into the fibril forming area between the heated roll and the thermoplastic material as the thermoplastic separates from the roll. The coolant may be supplied from the side of the polymer remote from the heated surface either in addition to or as an alternative to cooling from the front.

It has also been proposed to feed the polymeric material to the heated surface together with a backing material with the polymeric material between the heated surface and the backing so that the polymer softens and one side bonds to the backing material under the influence of the heated surface whilst the fibrils are drawn out from the other side of the polymer. These techniques produce laminar materials consisting of the pilous synthetic polymeric material bonded to the backing. Hereagain the coolant may be supplied from the side of the backing remote from the heated surface either in addition to or as an alternative to cooling from the front, cooling from the back is preferred when the backing is porous.

The processes described above have been operated successfully with polymers of melting temperatures below 200° C which can be melted and bonded to the backing without adversely affecting the backing material and which may be achieved with economic apparatus. However, we have encountered difficulties in processing certain polymers which have glass/rubber transition temperatures above ambient and which crystallise at elevated temperatures since we have found it difficult to draw crystalline materials to a satisfactory pile. Examples of such polymers include polyesters such as polyethylene terephthalate which has a crystalline melting point at around 265° C. It is well known that amorphous sheets may be obtained by extruding polyethylene terephthalate and rapidly cooling the extrudate to below the glass/rubber transition temperature. However, the polymer will crystallise rapidly when it is subsequently heated to between about 100° C and 200° C although crystallisation is slower at temperatures from about 200° C to the crystalline melting point. Crystallisation tends to solidify and embrittle polyethylene terephthalate which renders it unsuitable for conversion into pile by the techniques previously described.

The present invention therefore provides a process for the production of pile surfaced sheets from crystal forming polymers with glass/rubber transition temperatures above ambient temperature comprising feeding the polymer in its amorphous state into contact with a heated surface rapidly raising the temperature of the polymer to a temperature which is below the crystallisation melting point but at which it may be drawn into fibres and at which it adheres to the surface and separating the polymer sheet from the surface so that fibrils of the polymer are drawn out due to its adhesion to the surface cooling the fibrils as they are formed and crystallising the polymer.

The present invention is particularly concerned with producing pile surfaces on polyester especially a polyethylene terephthalate which has a glass/rubber transition temperature about 70° and a crystallisation melting point around 265° C.

The present invention is therefore the discovery that by selecting amorphous film as the starting material and using certain processing conditions pile surfaced materials particularly of polyesters may be obtained. In addition we have found that by controlling the rate of cooling of the fibrils materials having changing degrees of crystallisation may be obtained. The faster the cooling the less crystalline the material. The polymer molecules may in addition be oriented if it is cooled as it is being drawn into fibrils and where such products are required we prefer that the material be cooled from behind as it is being withdrawn from the heated surface.

The process and products of our invention may be obtained using previously known techniques such as those described in our earlier published German Offenlegunsschrift 2221087 (British patent No. 1384707) and our copending application 55831/72. We have found that cast polyester film which has been cooled rapidly immediately after extrusion is a particularly suitable starting material.

The final pile surfaced material may be provided with a backing or not as is preferred. However, in either instance we prefer that a backing web be fed with the amorphous film to the surface. The polyester will bond the backing web to form a laminar structure although if an unsupported product is required the backing may be treated so that it may readily be separated from the polyester as is described in our copending British application No. 5021/74. Examples of suitable backing materials are paper, cardboard and woven and non-woven textiles.

In our preferred process the polymer is brought to filament forming condition by contact with the heated surface which is preferably a heated roller. We also prefer particularly when the polymer is polyethylene that the polymer be at a temperature between the crystalline melting point and 80° C, preferably 60° C therebelow. The surface of the roller may be smooth roughened or formed with cavities to define fibre formation although in our preferred process we use a substantially smooth or satin finished roller which is heated internally to the required temperature. It is to be understood that the term substantially smooth includes surfaces which have a satin finish or have been shot or sand blasted, and examples of such surfaces include polished metal surfaces such as steel or chrome and satin finish metal rolls and sand blasted metal rolls and the rolls may be coated with non-stick materials such as polytetrafluoroethylene.

As mentioned above we prefer to use a backing material to hold the polymer against the heated surface; the polymer may be laminated to the backing before it is fed to the heated surface or may be fed separately to the heated surface and laminated to the backing under the conditions of our process. Where, the polymer is supplied separately it may be supplied as particles or a continuous sheet to the backing web which will carry the material into contact with the heated surface and will fuse particulate material into a substantially continous layer and for this instance heating must be rapid to avoid crystallisation. The backing material may be in the form of a continuous belt to which the synthetic material adheres during the fibril forming process but which is separated from the pilous synthetic material after pile formation. Alternatively, the backing material may remain adhering to the pilous synthetic material to produce a laminated product.

If a backing material is used it may act as the sole device which holds the polymer against the heated surface or additional means such as a belt and/or roller may be provided. Where an additional means such as a roller or a belt is used with a backing to urge both the backing material and the polymer against the surface another important requirement is that the backing web should not stick to this additional means. In a preferred process we use a cooled roller as an additional backing means.

The techniques of the present invention have been found to produce particularly acceptable pile surfaced materials from polyesters such as polyethylene terephthalate although the invention is equally applicable to other crystal forming polyesters such as polypropylene terephthalate and polybutylene terephthalate.

The pile is formed on one side only of the polymer and consists of fibrils which are of the polymer and have been drawn out therefrom and are integral with the remainder thereof. The preferred length and density of the fibrils depends upon the use to which the product is to be put but our preferred products have fibrils of length in the range 0.5 to 8 millimeters which protrude at an average angle greater than 15° from the plane of the original film, preferably the material is provided with a backing to which the fibrils protrude at an angle of at least 15°.

In our preferred process to produce pile surfaced polyethylene terephthalate the amorphous polyethylene terephalate film and a backing are fed to a heated roll with the polymer between the backing and the roll, the surface temperature of the roll being in the range 179° to 260° C and is pressed against the roll to rapidly raise the temperature of the polyethylene terephthalate to within this range at which crystal formation takes place only slowly. The polyester is then withdrawn from the roll over a bar of the type described in our copending British application No. 55831/72 and cold air is blown into the nip formed between the hot roll and the polyester as it moves away from the roll. The cold air may be blown from the back through the backing material if this material is porous. Controlling the cooling determines the crystallisation of the polymer, rapid cooling gives substantially amorphous material which may be subsequently heated to cause crystallisation, slower cooling to a temperature in the range 160° to 200° C induces crystallisation which can result in orientation if the temperature is reduced to a temperature in this range during fibril formation. The cooling should not however be so great that the viscosity of the polymer in the fibril forming zone is increased to a level at which it cannot be converted into fibrils.

The fibrils should be cooled as they are formed to ensure that they remain integral with the remainder of the polymer and/or the backing and do not stick permanently to the heated surface. Our preferred method of cooling is to use a jet of cold air which flows into the nip formed between the heated surface and the material as it moves away from the surface cooling should be uniform and thus the jet should extend across the total width of this nip. We have found that the actual direction of the jet of cold air is important to allow a free a circulation of the air as possible in the space between the heated surface and the polyester. The combination of the position and direction of the cooling jet and the path the material takes as it moves away from the roll is important in achieving the desired cooling and we prefer therefore to use the apparatus as is described in our copending British application No. 55831/72 whose content is included herein. We prefer that when using an apparatus as illustrated in this application the bar over which the material is withdrawn is positioned between 0.5 and 20 millimeters preferably 5 and 10 millimeters from the heated surface. Alternatively, the material may be cooled from the side furthest away from the heated surface which may conveniently be achieved either by cooling the bar or blowing air from the bar through the backing or by a combination of both these techniques. Such cooling from the back may be combined with front cooling.

The present invention also provides pile surfaced material comprising a polyester sheet having fibrils extending form one side thereof said fibrils being integral with the remainder of the sheeting the polymer in said fibrils being crystalline and oriented substantially along the major length of the fibrils.

The pile surfaced material may if desired be provided with a backing material such as paper, cardboard or woven and non-woven fabrics which may be laminated or heat bonded to the surface of the polyester which does not carry the pile. In addition the polymer may be crosslinked by the techniques described in our copending British application No. 55831/72.

The products of our invention have a pleasing appearance and may be used in decorative applications such as gift wrapping and other forms of packaging. In addition, the polyester could readily be subjected to textile treatments such as dyeing, fireproofing and treatment with antistatic. The present invention is illustrated but in no way limited by reference to the following examples in which an apparatus of the type illustrated in our copending British application No. 55831/72 was used. In all instances the feedstock was a film of amorphous polyethylene terephthalate produced by extruding a polyester sheet of approximate thickness 50 microns directly onto a water cooled drum. The amorphous film was fed to the roll between the roll surface and a paper backing.

The speed at which the amorphous polyester was heated and the rate at which it was cooled was varied to assess the effect on the final product. The processing conditions and product properties are summarised in the following tables.

| Web Speed | Roll Temp | Cold Air Flow |
|---|---|---|

-continued

| Example No. | M/min | T° C | Rate ($M^3$/min) |
|---|---|---|---|
| 1 | 1.0 | 190 | 2.50 |
| 2 | 1.0 | 190 | 4.25 |
| 3 | 1.0 | 190 | 1.25 |
| 4 | 1.0 | 205 | 1.25 |
| 5 | 1.0 | 187 | 4.50 |

| Example No. | Product Properties: Pile Height cm | Fibril Length cm | Fibril/Backing Angle (°) | Texture |
|---|---|---|---|---|
| 1 | 0.12 | 1.20 | 5 | Coarse fibrils |
| 2 | — | — | — | Laminated film |
| 3 | 0.11 | 1.20 | 5 | Coarse fibrils |
| 4 | 0.15 | 0.50 | 17 | Fine fibrils |
| 5 | 0.25 | 0.50 | 30 | Fine fibrils |

Thus it may be seen by comparing example 1 and 2 that the greater degree of cooling in example 2 increased the viscosity of the polymer to such an extent that fibrils could not be formed and a laminated film rather than a pile surfaced product was obtained. Example 3 however with its lower degree of cooling was less viscous and would be processed to produce an acceptable although somewhat coarse product.

Examples 4 and 5 were carried out using different machine setting giving the shorter fibril length and finer fibrils. I claim:

1. A process for the production of pile surfaced sheets from crystal forming polymers with glass/rubber transition temperatures above ambient temperatures comprising feeding the polymer in its amorphous state into contact with a heated surface, rapidly raising the temperature of the polymer to a temperature which is below the crystalline melting point but at which it may be drawn into fibres and at which it adheres to the surface and separating the polymer sheet from the surface so that fibrils of the polymer are drawn out due to its adhesion to the surface, cooling the fibrils as they are formed and crystallising the polymer.

2. A process according to claim 1 in which the crystal forming polymer is a thermoplastic polyester.

3. A process according to claim 2 in which the polyester is polyethylen terephthalate.

4. A process according to claim 1 in which the crystal forming polymer is cast polyester film.

5. A process according to claim 1 in which the heated surface is at a temperature between the crystalline melting point of the polymer and 80° C preferably 60° therebelow.

6. A process according to claim 1 in which a backing web is fed to the heated surface with the crystal forming polymer with the polymer between the backing and the heated surface.

7. A process according to claim 1 in which the heated surface is the surface of a roller.

8. A process according to claim 1 in which the fibrils are cooled by a stream of cooling fluid directed onto the fibril forming area.

9. A process according to claim 8 in which the stream of cooling fluid is directed onto the side of the polymer distant from the heated surface.

10. A process according to claim 1 in which the material is withdrawn from the heated surface over a guide rod positioned close thereto.

11. A process according to claim 1 in which the polymer is polyethylene terephthalate and the temperature of the heated surface is in the range 179° to 260°.

12. A process according to claim 11 in which the temperature of the polymer is reduced to a temperature in the range 160° to 200° as it is withdrawn from the heated surface.

13. Pile surfaced material comprising a polyester sheet having fibrils extending from one side thereof said fibrils being integral with the remainder of the sheet the polymer in said fibrils being crystalline and oriented substantially along the major length of the fibrils.

14. Pile surfaced material according to claim 13 in which the average length of the fibrils is in the range 0.5 to 8 millimeters.

15. Pile surfaced material according to claim 13 in which the material has a backing from which the fibrils protrude at an angle of at least 15°.

* * * * *